US006264449B1

(12) United States Patent
Maute et al.

(10) Patent No.: US 6,264,449 B1
(45) Date of Patent: Jul. 24, 2001

(54) PLASTIC TOOTHED WHEEL FOR A TOOTHED WHEEL PUMP

(76) Inventors: Alexander Maute, Erlenstrasse 26, D-72379 Hechingen-Stetten; Willi Schneider, Riemenschneidork 18, D-97616 Bad Neustadt, both of (DE)

( * ) Notice: Subject to any disclaimer, the term of this patent is extended or adjusted under 35 U.S.C. 154(b) by 0 days.

(21) Appl. No.: 09/504,811

(22) Filed: Feb. 16, 2000

(51) Int. Cl.[7] ..... F04C 2/00

(52) U.S. Cl. ..... 418/152; 418/206.9; 418/206.5; 425/524

(58) Field of Search ..... 418/152, 206.9, 418/206.5; 425/542

(56) References Cited

U.S. PATENT DOCUMENTS

| | | | | |
|---|---|---|---|---|
| 571,770 | * | 11/1896 | Kurz | 418/206.5 |
| 1,030,083 | * | 6/1912 | Green | 418/206.5 |
| 2,944,732 | * | 6/1960 | Lorenz | 418/206.5 |
| 4,086,043 | * | 4/1978 | Howe | 418/152 |
| 4,717,322 | * | 1/1988 | Masuda et al. | 418/152 |
| 5,244,367 | * | 9/1993 | Aslin | 418/152 |
| 5,310,320 | * | 5/1994 | Timuska | 418/152 |
| 5,895,210 | * | 4/1999 | Nakaniwa et al. | 418/206.9 |

FOREIGN PATENT DOCUMENTS

| | | | | |
|---|---|---|---|---|
| 687442 | * | 12/1953 | (GB) | 418/152 |
| 2141486 | * | 12/1984 | (GB) | 418/152 |
| 64-066488 | * | 3/1989 | (JP) | 418/152 |
| 2-102388 | * | 4/1990 | (JP) | 418/152 |
| 4-041984 | * | 2/1992 | (JP) | 418/152 |

* cited by examiner

*Primary Examiner*—Thomas Denion
*Assistant Examiner*—Theresa Trieu

(57) ABSTRACT

A plastic toothed wheel for a toothed wheel pump comprises a wheel body (20) having external or internal teeth. To keep the weight of this toothed wheel as low as possible, its teeth (26) have at least one cavity (32) accessible from at least one end face of the tooth. Toothed wheel pumps having such toothed wheels for supplying and pressurizing engine oil in automotive vehicle engines avoid splashing losses caused by the cavities (32) by closing the cavities or filling them up with a temperature and media resistant foam material (66).

22 Claims, 3 Drawing Sheets

Fig. 1
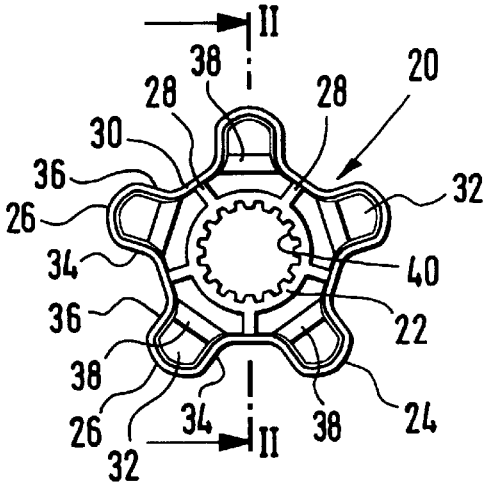
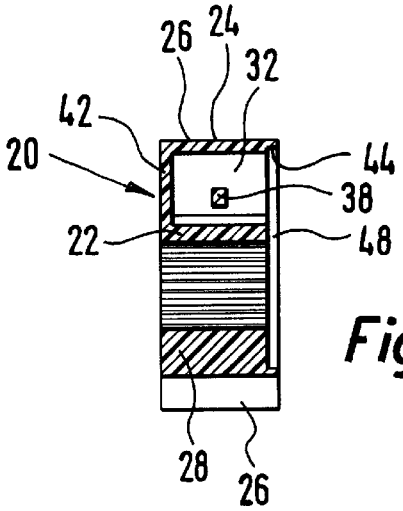
Fig. 2
Fig. 3
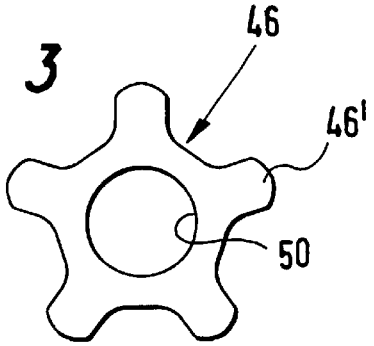
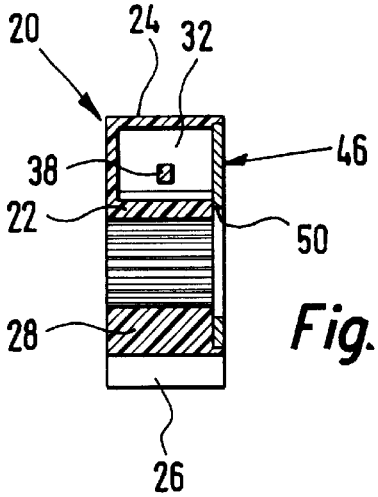
Fig. 4

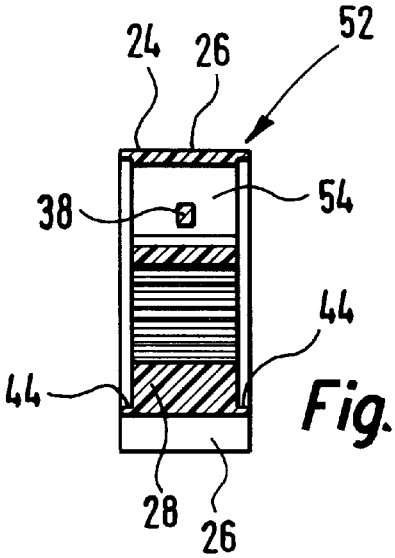
Fig. 5
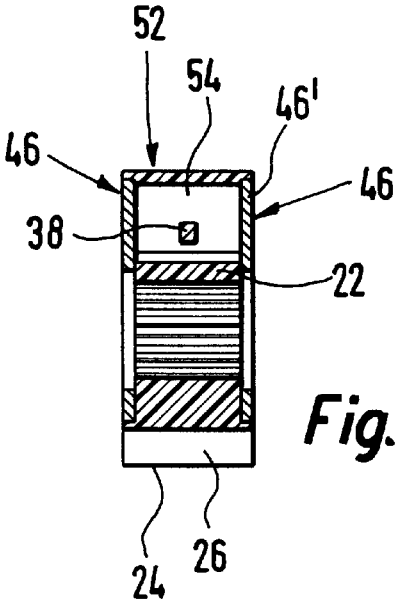
Fig. 6
Fig. 7
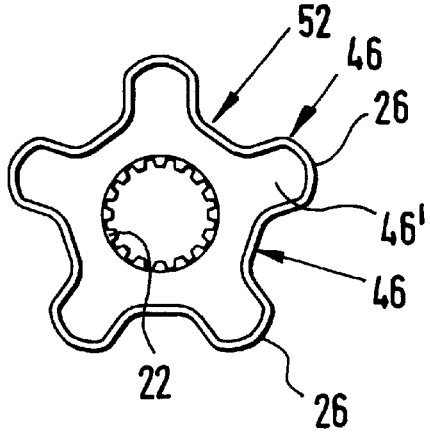

PLASTIC TOOTHED WHEEL FOR A TOOTHED WHEEL PUMP

BACKGROUND OF THE INVENTION

The invention concerns a plastic toothed wheel for a toothed wheel pump, the wheel body of which comprises external or internal teeth having at least one tooth cavity accessible from at least one tooth end face.

Toothed wheel pump toothed wheels of this kind are disclosed in DE GM 298 10 548.9.

The hollow tooth design of such toothed wheels, injection-molded from plastic, facilitates manufacture of teeth having uniform walls, wherein the wheel weight is considerably reduced. Prolonged lifetimes can be achieved by using special plastic materials for manufacture of the toothed wheel.

However, use of toothed wheel pumps having such toothed wheels for supplying and pressurizing engine oil in automotive vehicles leads to intolerable splashing losses when the teeth are hollow.

It is therefore the underlying purpose of the invention to further develop toothed wheels of this type in such a manner that splashing of supply media is avoided.

SUMMARY OF THE INVENTION

This object is achieved in accordance with the invention by closing the tooth cavities at the front or by filling them up with a temperature and media resistant, light-weight filling material of low specific weight.

The tooth cavities can thereby be formed with an opening penetrating completely through the teeth in the direction of the wheel axis or by shaping the teeth as basins (as viewed in longitudinal section).

In both cases, it can be advantageous to provide a lid for each front-end tooth opening e.g. via closing elements preferably formed on a covering plate which is mounted to the front end of the toothed wheel. Such covering plates can be mounted to the toothed wheel after injection-molding of the wheel body. The covering plates are preferentially disposed in the corresponding front end of the wheel body at such a depth as to end flush and coplanar with the front end of the teeth.

Such covering plates can be made from thin walled plastic or metal, in particular aluminum, and can be glued to or into the wheel body.

For toothed wheels having tooth cavities open at both tooth front ends, the covering plates to be mounted on both sides of the toothed wheel can be advantageously attached in a rigid, mutually connecting fashion using connecting elements protruding into the tooth cavities.

In a further embodiment of the invention having tooth cavities closed with covering plates mounted to one or both wheel front ends, the amount of plastic needed for producing the wheel body can be reduced and toothed wheels comprising external teeth with walls of identical geometrical shape can be effected when the wheel body comprises a hub and a toothed ring surrounding that hub at a radial distance therefrom, wherein the toothed ring and hub are connected to one another via radial bridges. The hub and toothed ring thereby define large volume cavities in the teeth which can be closed at the front end, depending on the design of the wheel body, with one or two covering plates.

Foamed plastic e.g. silicon foam can preferentially be used to fill the teeth cavities with a temperature and media resistant filling material. Either the same or different plastic materials can be used for the wheel body and the filling material. In the first case, one can use e.g. polyetheretherketone (PEEK) and in the second case polyetheretherketone (PEEK) for the wheel body and polyester (PES) for the filling material. In addition, plastic combined with ceramic powder can be used as the filling material.

Filling of the cavities with filling material can be advantageously effected directly after injection-molding the wheel body and within the injection tool (2K method).

The drawing shows embodiments of the invention.

BRIEF DESCRIPTION OF THE DRAWING

FIG. 1 shows a front view of a first embodiment of a wheel body of an internal toothed wheel of a toothed wheel pump, wherein the cavities of the teeth are accessible from one end face only;

FIG. 2 shows an axial section along the line II—II of FIG. 1;

FIG. 3 shows a front view of a covering plate for closing the cavities of the wheel body;

FIG. 4 is a representation similar to FIG. 2 with a covering plate disposed on the wheel body;

FIG. 5 shows an axial section through a wheel body, corresponding to the peripheral shape of the wheel body in accordance with FIG. 1, whose tooth cavities are open at both end faces;

FIG. 6 is a representation similar to FIG. 5, wherein the wheel body is closed at the front by the covering plates;

FIG. 7 shows a front view of the toothed wheel in accordance with FIG. 6;

DESCRIPTION OF THE PREFERRED EMBODIMENT

Figure 8:
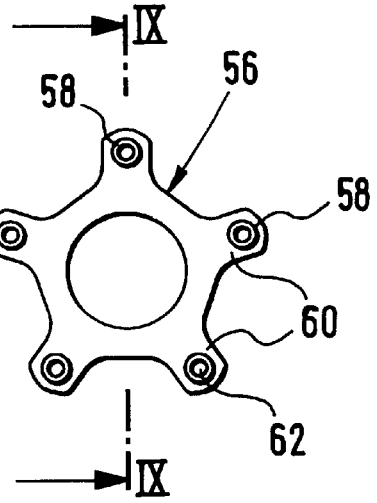
FIG. 8 shows a front view of a structural variant of a covering plate.

The wheel bodies 20 of the various embodiments of internal teeth for toothed wheel pumps in accordance with the invention shown in the drawings are injection molded from plastic, e.g. PEEK and have e.g. identical peripheral shapes, comprising a hub 22 and a toothed ring 24 with e.g. five teeth 26 surrounding the hub 22 with radial play.

Both parts 22, 24 are interconnected via radial bridges 28 which bridge the separation between the hub outer circumference and the toothed ring wall portion 30 in the tooth base region.

A cavity 32 therefore extends between neighboring radial bridges 28 into each of the teeth 26. The structure shown permits formation of a thin walled hub and toothed ring 24 with a correspondingly low weight for the wheel body 20 and which therefore can be manufactured with less material.

In order to provide the teeth 26 in the side region with sufficient rigidity despite the thin walls of the toothed ring 24, at least one connection piece 38, bridging the mutual side gap, is disposed within the teeth 26 in the transition area between the tooth sides 33, 36 and the toothed ring wall portion 30, tangentially to the hub 22, and is preferably disposed in the longitudinal center of the teeth (FIG. 2). 40 designates internal hub teeth for secure rotation of the internal toothed wheel with a pump shaft on which it is mounted.

FIG. 2 shows that the cavities 32 of the wheel body 20 are closed at one front end such that, viewed in longitudinal section, the teeth 26 are shaped as basins, with the basin bottom being designated with 42. As shown in FIG. 2, the wheel body 20 comprises a circumferential inner shoulder 44 at its open end face which is offset from the outer end face of the toothed ring 24 by an amount corresponding to the thickness of a covering plate 46. The covering plate 46 prevents splashing losses and matches the circumferential shape of the wheel body 20 in such a manner that it can be inserted with positive fit into the end-face cavity 48 formed by the inner shoulder 44. The covering plate 46 has a corresponding central recess 50 for the internal hub teeth 40 and is preferably held in the wheel body 20 by gluing (FIG. 4).

The variant of a wheel body 52 shown in FIG. 5 differs from the wheel body 20 in that its cavities 54 axially penetrate the wheel body. To avoid splashing losses, these cavities 54 are closed by covering plates 46 inserted at both end faces of the wheel body 52 which are disposed like the ones shown for the covering plate 46 of FIG. 4.

Figure 9:
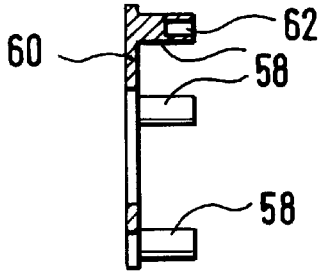
FIG. 9 shows an axial section through the covering plate in accordance with FIG. 8, viewed along sectional line IX—IX thereof.
Figure 10:
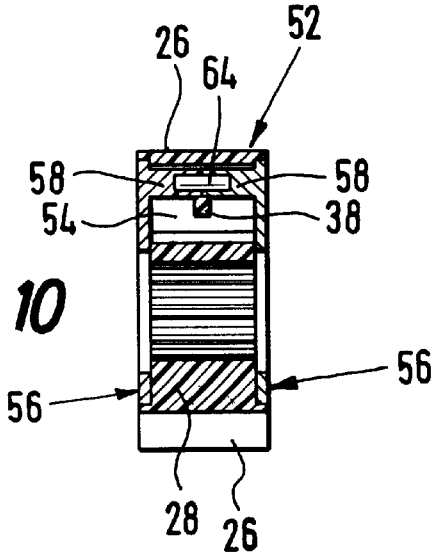
FIG. 10 shows an axial section through the wheel body in accordance with FIG. 5 which is closed at both front ends by covering plates in accordance with FIG. 8.

FIGS. 8 to 10 show a further possibility for fastening the covering plates, designated in their entirety with 56. They are constructed for mutual mechanical connection, wherein gluing into the wheel body is no longer necessary. For this purpose, one of their end faces is provided with connecting elements 58 protruding therefrom which are each disposed on circumferential projections 60 closing the front ends of the teeth 26. Each covering plate 56 is preferably formed as a one-piece plastic molding part, wherein their connection elements 58 protrude into the cavities 54 and can be brought into locking engagement with one another. For this purpose, the connecting elements 58 can be fashioned differently. It is e.g. feasible to design the connecting elements 58 such that they are locked into each other. In the present embodiment, this is effected using a pin connection for which the connecting elements have a central recess 62. One covering plate 56 can be provided with pins 64 inserted into these recesses 62, which are brought into frictional engagement with corresponding recess 62 in the opposing covering plate 56 when disposing the covering plate 56 onto the wheel body 52. It is also feasible to provide the connecting elements 58 of the one covering plate 56 with shaped cylindrical pins which can then be brought into engagement with corresponding recess 62 in the other covering plate 56.

Figure 11:
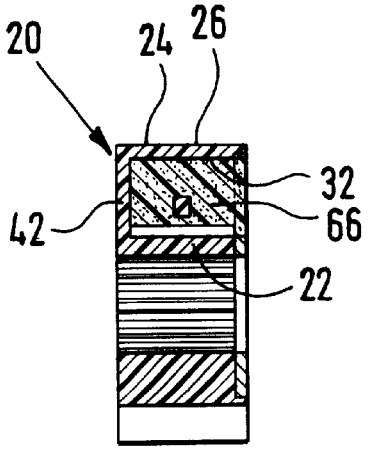
FIG. 11 shows an axial section through a wheel body, similar to the wheel body in accordance with FIG. 2, whose cavities are filled with a foamed filling material.

The wheel body of the construction variant of a toothed wheel shown in FIG. 11 corresponds preferably to the wheel body 10 of FIGS. 1 and 2. The structural difference with respect to the last-mentioned embodiment is that the cavities 32 of the wheel body 20, which are closed on one side, are not closed by an end-face covering plate 46, rather are filled with a foam filling material 66 having temperature and medium resistant properties. The plastic material could e.g. be the same as used for injection-molding the wheel body 20. The volume integrated weight is considerably reduced by foaming the plastic, so that the weight of this toothed wheel corresponds approximately to that of the one whose cavities 32 are closed by the covering plate 46.

The filling material may also differ from the material used for the wheel body 20. In particular, a ceramic powder or the like can be mixed with the plastic which is to be foamed.

The wheel body 20 can also be designed in a different manner than described and can be analogous e.g. to that of the toothed wheel having external teeth as disclosed in FIGS. 1and 2 of DE GM 298 10 548.9.

What is claimed is:

1. A plastic toothed wheel for a toothed wheel pump, the tooth wheel comprising:

a plurality of external teeth, each of said teeth defining a cavity having a first access opening at a first tooth face;

means for closing said first access opening; a central hub;

a toothed ring annularly surrounding said hub at a radial distance therefrom; and radial bridges connected between said toothed ring and said central hub, wherein said teeth are disposed about said toothed ring.

2. The toothed wheel of claim 1, wherein said closing means comprise a cover element.

3. The toothed wheel of claim 2, wherein said first tooth face is closed by said cover element.

4. The toothed wheel of claim 3, wherein said cover element comprises a covering plate mounted at said first tooth face.

5. The toothed wheel of claim 4, wherein said covering plate is sunk into said tooth face at said first access opening and is flush with said first tooth face.

6. The toothed wheel of claim 4, wherein said covering plate is made from plastic.

7. The toothed wheel of claim 4, wherein said covering plate is made from metal.

8. The toothed wheel of claim 4, wherein said covering plate is glued to the toothed wheel.

9. The toothed wheel of claim 1, wherein said closing means comprise a foamed filling material of low specific weight disposed within said cavity, said filling material being at least one of temperature and medium resistant.

10. The toothed wheel of claim 9, wherein said filling material is formed plastic.

11. The toothed wheel of claim 10, wherein said tooth and said filling material are made from a same plastic material.

12. The toothed wheel of claim 11, wherein said same plastic material is polyetheretherketone (PEEK).

13. The toothed wheel of claim 10, wherein said teeth are made from polyetheretherketone (PEEK) and said filling material is polyester (PES).

14. The toothed wheel of claim 10, wherein said filling material is plastic material with ceramic powder.

15. The toothed wheel of claim 1, wherein said teeth have a basin-shaped longitudinal section.

16. The toothed wheel of claim 1, wherein said cavity has a second access opening at a second tooth face opposite said first tooth face, wherein said closing means close said first and said second access opening.

17. The toothed wheel of claim 16, wherein said closing means comprises a first covering plate mounted at said first tooth face and a second covering plate mounted at said second tooth face.

18. The toothed wheel of claim 17, wherein said first covering plate is sunk into and flush with said first tooth face and wherein said second covering plate is sunk into and flush with said second tooth face.

19. The toothed wheel of claim 17, further comprising a connecting element projecting through said cavity to rigidly connect said first covering plate to said second covering plate.

20. The toothed wheel of claim 1, wherein said radial bridges bridge a separation between an outer circumference of said hub and a wall part of said toothed ring proximate a tooth base.

21. The toothed wheel of claim 1, wherein each cavity defined by said teeth has at least one supporting bridge disposed tangentially with respect to said hub to bridge a mutual separation between wall portions of said toothed ring forming sides of said teeth.

22. The toothed wheel of claim 21, wherein said supporting bridge is disposed in a longitudinal center of said cavity in a transition area of said wall portions intermediate between said teeth sides and teeth bottoms.

* * * * *